US005765607A

United States Patent [19]

Ansaloni

[11] Patent Number: 5,765,607

[45] Date of Patent: Jun. 16, 1998

[54] MACHINE FOR METERING PHARMACEUTICAL PRODUCTS INTO CONTAINERS

[75] Inventor: Angelo Ansaloni, Crespellano, Italy

[73] Assignee: MG2 S.p.A., Pian di Macina-Pianoro, Italy

[21] Appl. No.: 730,050

[22] Filed: Oct. 15, 1996

[30] Foreign Application Priority Data

Oct. 16, 1995 [IT] Italy ..... BO95A0488

[51] Int. Cl.[6] ..... B65B 1/04

[52] U.S. Cl. ..... 141/135; 141/70; 141/67; 141/144

[58] Field of Search ..... 141/129, 131, 141/135–138, 144, 156, 163, 167, 178, 179, 183–185, 192, 234, 237, 238, 242, 243, 248, 250, 270, 283, 284, 18, 67, 70, 71; 53/251, 900; 222/152, 636

[56] References Cited

U.S. PATENT DOCUMENTS

| | | | |
|---|---|---|---|
| 2,540,059 | 1/1951 | Stirn et al. . | |
| 4,005,668 | 2/1977 | Washington et al. | 141/129 |
| 4,469,144 | 9/1984 | Burns | 141/129 |
| 4,709,837 | 12/1987 | Erdman . | |
| 5,287,897 | 2/1994 | Gamberini | 141/178 |
| 5,406,990 | 4/1995 | Haeberli | 141/137 |

FOREIGN PATENT DOCUMENTS

| | | | |
|---|---|---|---|
| 0 347 544 | 12/1989 | European Pat. Off. . | |
| 2 647 298 | 11/1990 | France . | |
| 2 262 362 | 6/1973 | Germany . | |
| 662806 | 5/1979 | U.S.S.R. | 222/636 |
| 1109407 | 4/1968 | United Kingdom . | |

*Primary Examiner*—Henry J. Recla
*Assistant Examiner*—Steven O. Douglas
*Attorney, Agent, or Firm*—Finnegan, Henderson, Farabow, Garrett & Dunner, L.L.P.

[57] ABSTRACT

A machine for metering pharmaceutical products into containers, each presenting, at least one given portion, a seat for a pharmaceutical product in the form of small-size particles; a conveyor being provided to convey the containers in a given direction through an operating station; a metering unit being provided for feeding the product into the containers by means of at least one dispenser; the dispenser presenting a number of nozzles for receiving the product from a hopper of the dispenser and subsequently feeding the product into the seat and a dispensing device for regulating flow of the product through the nozzles.

9 Claims, 2 Drawing Sheets

MACHINE FOR METERING PHARMACEUTICAL PRODUCTS INTO CONTAINERS

The present invention relates to a machine for metering pharmaceutical products into containers.

SUMMARY OF THE INVENTION

It is an object of the present invention to provide a straightforward, low-cost machine for metering pharmaceutical products.

According to the present invention, there is provided a machine for metering pharmaceutical products into containers, each container presenting a seat in a given portion of said container and for receiving pharmaceutical products defined by small-size particles; and the machine comprising an operating station, and a metering unit for dispensing said products; characterized in that said unit comprises at least one dispensing member presenting at least one hopper containing said product, and a number of nozzles for receiving said product from the hopper; and said unit also comprising an actuating device for moving said dispensing member through said station so that a nozzle containing said product is positioned facing said seat at said station.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
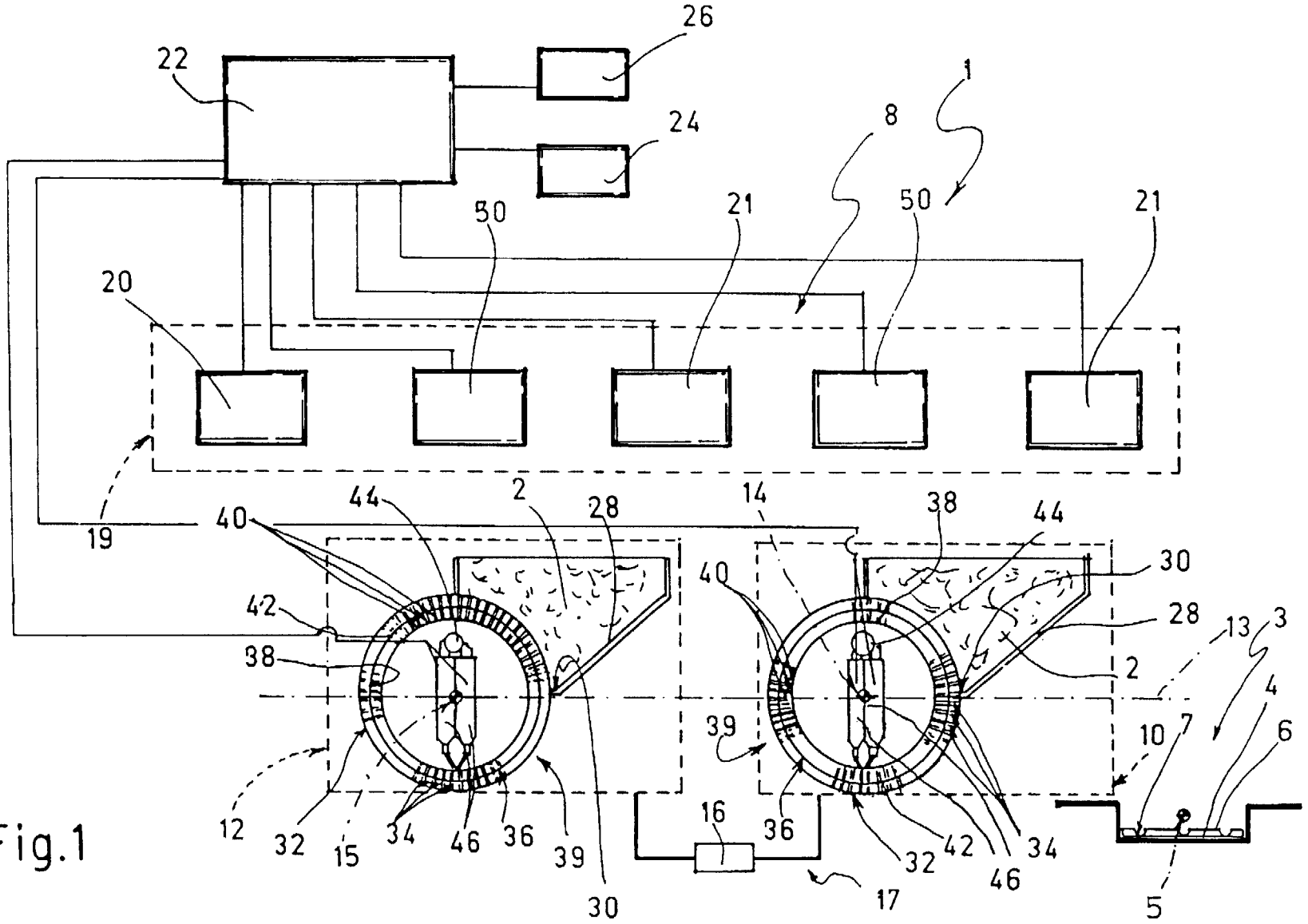
FIG. 1 shows a partially sectioned schematic front view of a machine in accordance with the teachings of the present invention.

Number 1 in FIG. 1 indicates a machine for metering pharmaceutical products 2 normally comprising chemical substances in the form of powder or granules.

Machine 1 comprises an operating station 3 at the output of machine 1; and a conveyor 4 with a horizontal conveying branch extending through station 3 in a given substantially horizontal direction 5 (FIG. 2), and which provides for conveying, in steps or continuously, containers 6 of a given form, e.g. sheets known as "blisters", made of plastic or metal material and presenting a number of cavities 7 arranged in a given geometrical pattern.

Machine 1 also comprises a metering unit 8 located over conveyor 4 and for gravity feeding given quantities of products 2 into blisters 6.

Unit 8 comprises, over conveyor 4, two dispensing members 10 and 12 substantially aligned with each other in a substantially horizontal direction 13 perpendicular to direction 5, and which are connected rigidly to each other by a connecting member 16 (shown schematically in FIG. 1) for ensuring members 10 and 12 are moved substantially identically at all times.

Figure 2:
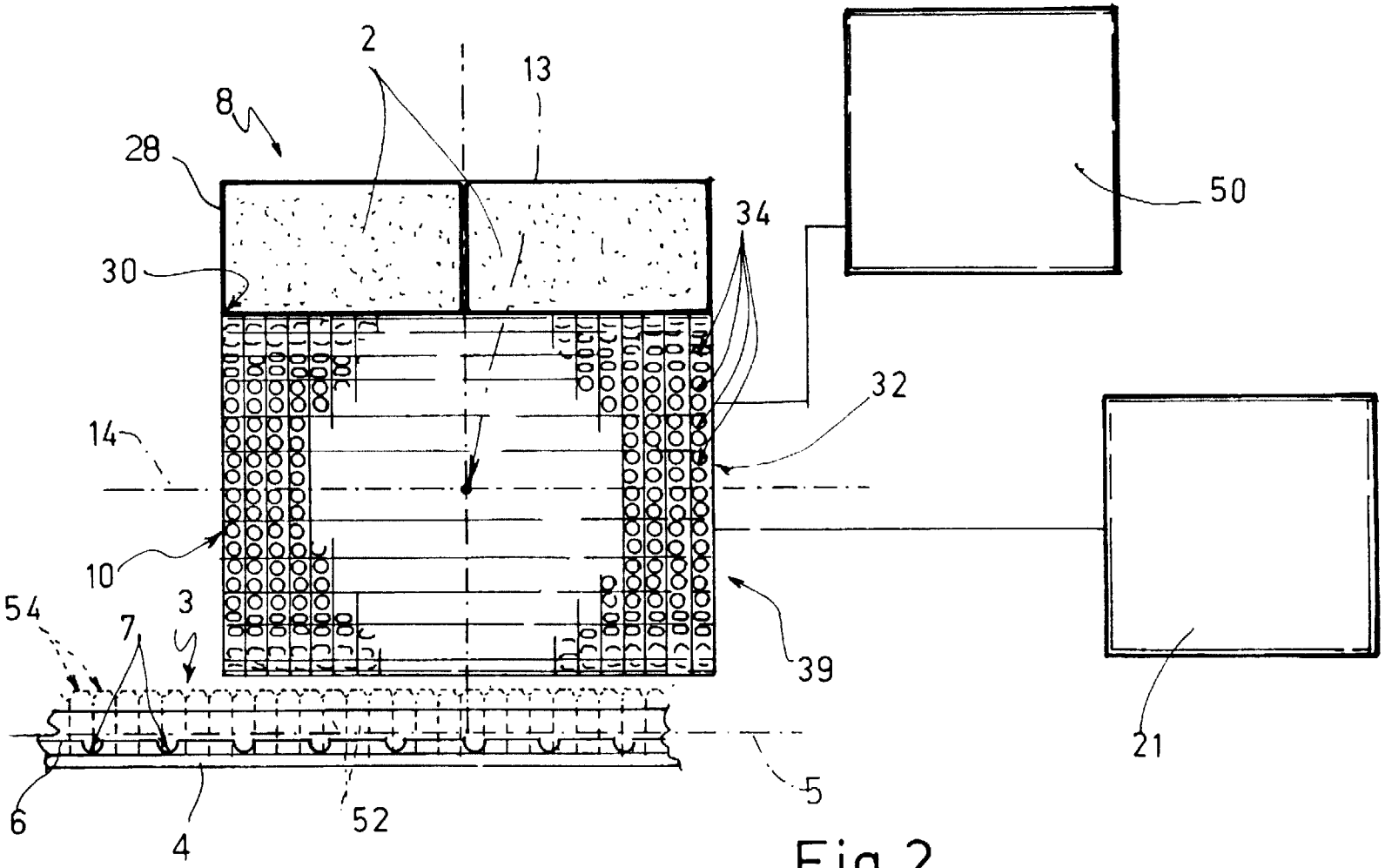
FIG. 2 shows a partially sectioned schematic side view, with parts removed for clarity, of the FIG. 1 machine.

Unit 8 also comprises an actuating device 19 for moving and supporting members 10 and 12, and which presents a linear actuator 20 (shown schematically in FIG. 1) operated in steps or continuously for moving members 10 and 12, through station 3 in direction 13, to and from a respective idle position in which members 10 and 12 are located downstream from station 3 in the traveling direction from member 10 to station 3 in FIG. 1, and are located astride station 3 as shown in FIG. 2. Device 19 also comprises a pair of linear actuators 21 (shown schematically in FIG. 1) which are operated in steps or continuously for selectively moving members 10 and 12, through station 3 in direction 5, to and from the idle position. By means of actuators 20 and 21, device 19 therefore provides for moving members 10 and 12 within a substantially rectangular work area defined by opposite sides parallel to directions 5 and 13.

Unit 8 also comprises an electronic central control unit 22; a pneumatic device 24 for producing high-pressure gas, normally air; and a further pneumatic device 26 for generating a vacuum. For the sake of simplicity, central control unit 22 and devices 24 and 26 are shown schematically in block form, and the operation of each is described in detail later on.

Since members 10 and 12 are substantially identical, only one will be described herein, for the sake of simplicity, using the same numbering system for the corresponding component parts of both.

Member 10 extends along an axis 14 parallel to direction 5, and comprises at least one substantially prismatic hopper 28 (two in the example shown, as illustrated in FIG. 2) presenting a downward-facing opening 30. Beneath hopper 28, member 10 comprises a ring 32 coaxial with axis 14, freely rotatable and axially fixed in relation to axis 14, and presenting a number of radial through openings or nozzles 34, each of which sweeps past bottom opening 30 of hopper 28 at each turn of ring 32, and is connected in airtight manner to hopper 28 so that, when device 24 is activated, a vacuum is substantially maintained in nozzles 34.

Member 10 also comprises a dispenser 36 extending along axis 14 and which in turn comprises a further ring 38 coaxial with axis 14 and housed inside ring 32, and a number of radial conduits 40 equally spaced about axis 14 and substantially equal in number to nozzles 34. More specifically, each nozzle 34 constantly faces a corresponding conduit 40 from which it is separated by a porous cylindrical body 42 interposed between rings 32 and 38 and which provides for preventing product 2 from being transferred from nozzle 34 to respective conduit 40, but for permitting the passage of air or other similar gas from conduit 40 to respective nozzle 34. It should be pointed out that body 42 mates constantly in contact with rings 32 and 38, together with which it defines a dispensing body 39 freely rotatable about axis 14 (axis 15 in the case of member 12).

Dispenser 36 also comprises, inside ring 38, a supply conduit 44 substantially parallel to and over axis 14 and which is supplied with pressurized gas by device 24; and a number of on-off valves 46, each of which is positioned substantially vertically and connects supply conduit 44 in airtight manner to a respective conduit 40 positioned vertically and substantially facing a cavity 7 of a blister 6 arrested in station 3.

Operation of machine 1 will now be described as of the condition in which members 10 and 12 are maintained in the respective idle positions by device 19; each hopper 28 is filled with respective product 2; and a blister 6 is stationary on the conveying branch of conveyor 4 in station 3.

Nozzles 34 commence drawing off product 2 when devices 24 and 26 are activated and dispensing body 39 is rotated clockwise (in FIG. 1) by device 19 via a respective rotary actuator 50 (shown schematically in the drawings). It should be pointed out that product 2 is fed into each nozzle 34 by force of gravity combined with the vacuum generated by device 24; that the product 2 inside nozzles 34 downstream from respective openings 30 is retained inside nozzles 34 by the suction generated by device 24, and does not escape even when nozzles 34 are located beneath axis 14, 15; and, finally, that, in any case, the inside of dispenser 36 is protected by body 42, which retains product 2 on the outside of ring 38.

At this point, once actuators 20 and 21 are operated to position a given nozzle 34 in station 3 and along the vertical axis of a given cavity 7, central control unit 22 opens the corresponding valve 46 for a given length of time to dispense product 2. As such, by appropriately controlling the operation of actuators 20, 21 and the opening of valves 46 of given nozzles 34 by means of central control unit 22, given quantities of product 2 may be dispensed from a given hopper 28 into a given cavity 7.

Cavities 7 of blister 6 may thus be filled with mixtures of pharmaceutical products prepared directly inside cavities 7; or cavities 7 of the same blister 6 may be filled with different mixtures of pharmaceutical products contained inside hoppers 28 of members 10 and 12.

It should be pointed out that arresting blisters 6 in station 3 is only one of the possible operating modes of machine 1. In fact, the filling of cavities 7 may be speeded up by central control unit 22 so operating device 19 and conveyor 4 as to feed a given cavity 7 towards a given nozzle 34 at any rate as required.

Clearly, changes may be made to machine 1 as described and illustrated herein without, however, departing from the scope of the present invention.

For example, if cavities 7 of blisters 6 are filled with more than two pharmaceutical products for each dispensing member 10, 12, the number of hoppers 28 may be increased, even to the extent of providing a hopper 28 for each nozzle 34.

Conversely, if cavities 7 are filled with only one pharmaceutical product, each member 10, 12 may be provided with a single hopper 28.

Machine 1 may also be employed in the event blisters 6 are replaced by bottles 52 or the bottom portions of hard gel capsules, in which case, the alterations to machine 1 substantially involve conveyor 4, the conveying branch of which must be so adjusted in height as to enable bottles 52 or the bottom capsule portions to travel freely beneath nozzles 34. Bottles 52 and the bottom capsule portions must, of course, be supplied to station 3 in a given pattern, so that the respective inlets 54 are arranged in the same way as cavities 7 of blisters 6.

I claim:

1. A machine for metering pharmaceutical products into containers, each container presenting a seat in a given portion of said container adapted to receive pharmaceutical products defined by small-size particles; the machine comprising an operating station, and a metering unit for dispensing said products; said unit including at least one dispensing member presenting at least one hopper adapted to contain said product, and a plurality of nozzles adapted to receive said product from the hopper; said unit further including an actuating device for moving said dispensing member through said station so that a nozzle of the plurality of nozzles and containing said product is positioned facing said seat at said station; said machine further including a conveyor extending in a given substantially horizontal first direction; said conveyor conveying said containers through said station in said first direction; and said unit being located substantially to a side of said station to support and move said dispensing member through said station so that the nozzle containing said product is positioned facing said seat at said station; said dispensing member defining a longitudinal axis substantially perpendicular to said first direction; said dispenser being coaxial with and rotatable about said longitudinal axis, and including a first ring coaxial with said longitudinal axis; said first ring presenting a plurality of radial conduits; said radial conduits being equally spaced about said longitudinal axis; said dispenser including a substantially cylindrical filtering body coaxial with said longitudinal axis; and each of said radial conduits for facing a respective said nozzle and being separated from said nozzle by said filtering body to prevent the passage of said product from said nozzles to said radial conduits.

2. A machine as claimed in claim 1, wherein said dispenser includes a second ring coaxial with and outside said first ring; said filtering body being a cylindrical body interposed between and mating constantly in contact with said first and second rings.

3. A machine as claimed in claim 2, wherein said nozzles are formed in said second ring; said hopper presenting, on a dispenser side, an opening enabling communication between said second ring and the respective said nozzles.

4. A machine as claimed in claim 3, wherein, inside said second ring, said dispenser includes a supply conduit substantially parallel to said longitudinal axis, and a plurality of valves; each of said valves connecting said supply conduit in airtight manner to one of said nozzles.

5. A machine as claimed in claim 4, wherein said unit includes a first pneumatic device communicating with said radial conduits and for forming and maintaining a vacuum in said radial conduits; and a second pneumatic device for supplying said supply conduit with pressurized gas.

6. A machine as claimed in claim 5, wherein said actuating device includes a first actuator for moving said dispensing member through said station in said first direction;

and a second actuator for moving said dispensing member through said station in a second direction substantially perpendicular to said first direction.

7. A machine as claimed in claim 6, wherein said actuating device includes a third actuator for rotating said dispenser about said longitudinal axis so that a given nozzle is alternately positioned facing the respective said opening of the hopper and over a said seat.

8. A machine as claimed in claim 7, wherein said first and second actuators are operated in steps or continuously.

9. A machine as claimed in claim 8, wherein said unit includes an electronic central control unit connected to said first and second pneumatic devices to control the vacuum generated in said radial conduits and to selectively open and close said valves to control the vacuum generated in said nozzles; said central control unit also controlling said first and second actuators to move said dispensing member within a substantially rectangular work area.

* * * * *